US008469176B2

(12) United States Patent
Matheisl et al.

(10) Patent No.: US 8,469,176 B2
(45) Date of Patent: Jun. 25, 2013

(54) STEP FOR ESCALATOR OR PLATE FOR TRAVELATOR, AND ESCALATOR OR TRAVELATOR AND METHOD FOR PRODUCTION

(75) Inventors: Michael Matheisl, Österreich (AT); Thomas Illedits, Österreich (AT); Thomas Novacek, Österreich (AT); Gerhard Kleewein, Österreich (AT)

(73) Assignee: Inventio AG, Hergiswil NW (CH)

( * ) Notice: Subject to any disclaimer, the term of this patent is extended or adjusted under 35 U.S.C. 154(b) by 198 days.

(21) Appl. No.: 12/680,787

(22) PCT Filed: Sep. 26, 2008

(86) PCT No.: PCT/EP2008/062963

§ 371 (c)(1), (2), (4) Date: Mar. 30, 2010

(87) PCT Pub. No.: WO2009/047142

PCT Pub. Date: Apr. 16, 2009

(65) Prior Publication Data

US 2010/0206692 A1 Aug. 19, 2010

(30) Foreign Application Priority Data

Oct. 1, 2007 (EP) ..... 07117647

(51) Int. Cl.
*B66B 21/00* (2006.01)

(52) U.S. Cl.
USPC ..... 198/333; 198/321

(58) Field of Classification Search
None
See application file for complete search history.

(56) References Cited

U.S. PATENT DOCUMENTS 7,841,460 B2 * 11/2010 Streibig et al. ..... 198/333

FOREIGN PATENT DOCUMENTS

| | | | |
|---|---|---|---|
| GB | 2 173 757 A | | 10/1986 |
| GB | 2173757 A | * | 10/1986 |
| GB | 2 216 825 A | | 10/1989 |
| JP | 50 016282 A | | 2/1975 |
| JP | 54 159990 A | | 12/1979 |
| JP | 62 270224 A | | 11/1987 |
| JP | 2001 310889 A | | 11/2001 |

* cited by examiner

*Primary Examiner* — Kavel Singh
(74) *Attorney, Agent, or Firm* — Ladas & Parry LLP

(57) ABSTRACT

The escalator step (1) or the travelator plate comprises a step skeleton (2) or a plate skeleton which carries at least one tread element (22). A first cheek (3), a central cheek (4), a second cheek (5), a carrier (6), a bridge (7) and a bracket (8) form the step skeleton (2). For each cheek (3, 4, 5), a sheet metal blank is stamped from a sheet metal strip and is subsequently formed into the cheek by means of deep drawing processes. The carrier (6), bridge (7) and bracket (8) connect the cheeks (3, 4, 5), wherein the components are welded by means of spot welding processes. The carrier (6), bridge (7) and bracket (8) are produced endlessly from sheet metal coil by means of a rolling deformation process and are cut to length depending on the step width.

10 Claims, 9 Drawing Sheets

STEP FOR ESCALATOR OR PLATE FOR TRAVELATOR, AND ESCALATOR OR TRAVELATOR AND METHOD FOR PRODUCTION

TECHNICAL FIELD

The invention relates to a step for an escalator or a plate for a moving walkway, comprising a step skeleton or plate skeleton as a support for at least one tread element, according the definition of the independent patent claim.

BACKGROUND OF THE INVENTION

A step for an escalator has become known from Patent Specification DD 69443 A. The step is of skeleton-like construction and substantially consists of a bent-over support plate which forms the side parts and the front part. A bracket to which the guide wheels of the step are fastened is arranged at the support plate. A bent-over tread plate is connected with the side parts by force coupling and serves as a step closure in upward direction. The front part of the step is closed by means of a front panel connected with the support plate.

Such a step is very heavy, because the support plate—notwithstanding beads provided for stiffening—has to be of relatively thick construction if the requisite stability is to be ensured.

A plate for a moving walkway has become known from GB 2173757 A, which defines the category. The tread element rests on three carriers arranged transversely to the travel direction. These carriers are constructed as angle sections. The three carriers in turn rest on three cheeks arranged in travel direction, wherein not only the two outer cheeks are mounted by rollers, but also the centre cheek. The cheeks are similarly formed from angle sections. Due to the total of six angle sections this construction is very heavy. In this connection it should also be noted that these previously known plates of moving walkways have only a low height. In the case of steps for escalators the individual cheeks would have to have an appropriately greater height, whereby steps provided with such previously known cheeks would have an extremely high weight. Moreover, in the case of steps for escalators, which run at an appropriate inclination, the angle sections have to be correspondingly processed and one limb cut to size obliquely.

BRIEF SUMMARY OF THE INVENTION

Here the invention will provide a remedy. The invention fulfils the object of creating a light step or plate, which is made of sheet metal, with a high level of stiffness.

A step executes a relative movement in vertical direction with respect to the adjacent step, particularly on transition from the inclined escalator section to the horizontal escalator section. The step structure of the escalator transforms into a plane or band structure. The relative movement is produced by an appropriate course of the guide tracks for the step rollers. Moreover, the step has, in section in travel direction, approximately a triangular cross-section. A plate does not execute a relative movement with respect to the adjacent plates in vertical direction. The moving walkway consisting of plates does not change its surface structure in the case of a change in direction, a stepless band structure as transport surface always being present. A plate is constructed comparably with a step and has, in section in travel direction, an approximately rectangular cross-section without a visible riser element. An escalator has at least one step according to the invention, wherein the remaining steps are, for example, conventional aluminium steps or sheet metal steps. In the following, for the sake better capability of reading there is description of just a step produced by means of a deep-drawing method. However, the explanations are analogously applicable to a plate produced by means of a deep-drawing method.

The advantages achieved by the invention are substantially to be seen in that weight savings and cost savings are possible with the skeleton-like sheet metal construction of the step. Lighter steps also mean a lower drive power for the escalator drive. The significant components of the steps, such as, for example, step cheeks, tread element and riser element, are produced from thin deep-drawn sheet metal by means of a deep-drawing method. Notwithstanding the thin sheet metal, the step according to the invention satisfies the prescriptions and load tests of European Standard EN 115 as well as American Standard ASME A17.1, according to which the step according to the invention has to satisfy a static test and a dynamic test. In the static test the step is centrally loaded with a force of 3000 N acting perpendicularly to the tread element, wherein a deflection of at most 4 mm may occur. After the action of the force, the step should not have any persisting deformation. In the dynamic test the step is centrally loaded by a pulsating force, wherein the force varies between 500 N and 3000 N at a frequency between 5 Hz and 20 Hz and at least $5\times10^6$ cycles. After the test the step may have a residual deformation of at most 4 mm.

It is further advantageous that the components can be produced in production-optimised manner from a sheet metal roll—which is held by means of an unwinding device and can be unwound—of, for example, 2 m to 4 m diameter, hereinafter called sheet metal coil. The work flow can be designed to be free of interruption and production time further reduced by multiple unwinding devices.

The step according to the invention with skeleton-like sheet metal construction is lighter and substantially more economic than a die-cast step of aluminium, particularly in view of the increasing price of aluminium. A 600 mm wide step still weighs approximately 8.6 kg, an 800 mm wide step still weighs approximately 10.8 kg and a 1000 mm wide step still weighs approximately 13.1 kg. It is additionally advantageous with this mode of construction that the step width or also the change-over process in a case of small batch numbers does not require expensive additional operations. A step optimised with respect to minimum weight and maximum load according to the above-mentioned EN 115 is possible with thin deep-drawn sheet metals of, for example 1.1 to 1.9 mm thickness, which by means of a deep-drawing method enable a maximum stiffness of the load-bearing components. Stamping or bending methods would also be conceivable, but the finished step would be substantially heavier, because in these production methods greater sheet metal thicknesses (at least 4 mm sheet metal thickness) are necessary.

It is significant with the present invention that the step skeleton or plate skeleton is made as sheet metal parts, i.e. shaped from planar elements. In that case the cheeks comprise a cheek body and, along the edges of the cheek body, an encircling wall-like stiffening. A surprisingly high stability is achieved by this stiffening, notwithstanding thin (and thus light) sheet metal. Such cheeks can advantageously be produced by a deep-drawing method.

In the deep-drawing method a die presses a planar sheet metal blank into a prefabricated die plate, wherein the edge of the sheet metal die is held fast by means of a holding-down device. In the case of cold deforming, which is produced by die and die plate, of the deep-drawn sheet metal a transient plasticising and cold-hardening of the deep-drawn sheet metal takes place below the holding-down device. A three-dimensional body with base and encircling walls is formed from the two-dimensional sheet metal blank, which is usually punched from a sheet metal strip, wherein the wall thickness is somewhat smaller than the original sheet metal thickness. The base can be reshaped in further method steps, for example by means of hydraulic drawing into the die or the die plate. In the exemplifying embodiment explained in the following the cheek eyes are thus produced. After the reshaping, the edge is separated from the walls by trimming, for example by means of a knife or laser or punch or water jet. The deep-drawn sheet metal has to be provided specifically for the reshaping. In the exemplifying embodiment explained below use is made of, for example, a deep-drawn sheet metal with the designation H380 or H400 or H900 or H1100. These steel types are substantially based on the strength-enhancing action of microalloying additives such as, for example, niobium and/or titanium and/or manganese. The yield points, which are high by comparison with soft steels, of these steel categories allow cold deforming, with low deforming load, to the point of very demanding and complex component shapings. The steel categories are matched to the respective deformation conditions, so that even in the case of small sheet metal thicknesses the tendency to deformation-induced contractions, formation of folds, tears or shape inaccuracies due to resilient springback is minimal. The deep-drawing method is distinguished by a large ratio of sheet metal thickness to height of the deep-drawn wall as well as the high degree of load-bearing capability, accuracy in shape and stability connected therewith.

In the case of a roll reshaping method, also termed continuous bending method, a sheet metal strip from a sheet metal coil is reshaped with the help of several roll pairs or roller pairs, which are arranged one behind the other, by cold deforming to form sections with high load-bearing capability.

BRIEF DESCRIPTION OF THE DRAWINGS

The present invention is explained in more detail by way of the accompanying figures, in which.

DETAILED DESCRIPTION OF A PREFERRED EMBODIMENT

Figure 1:
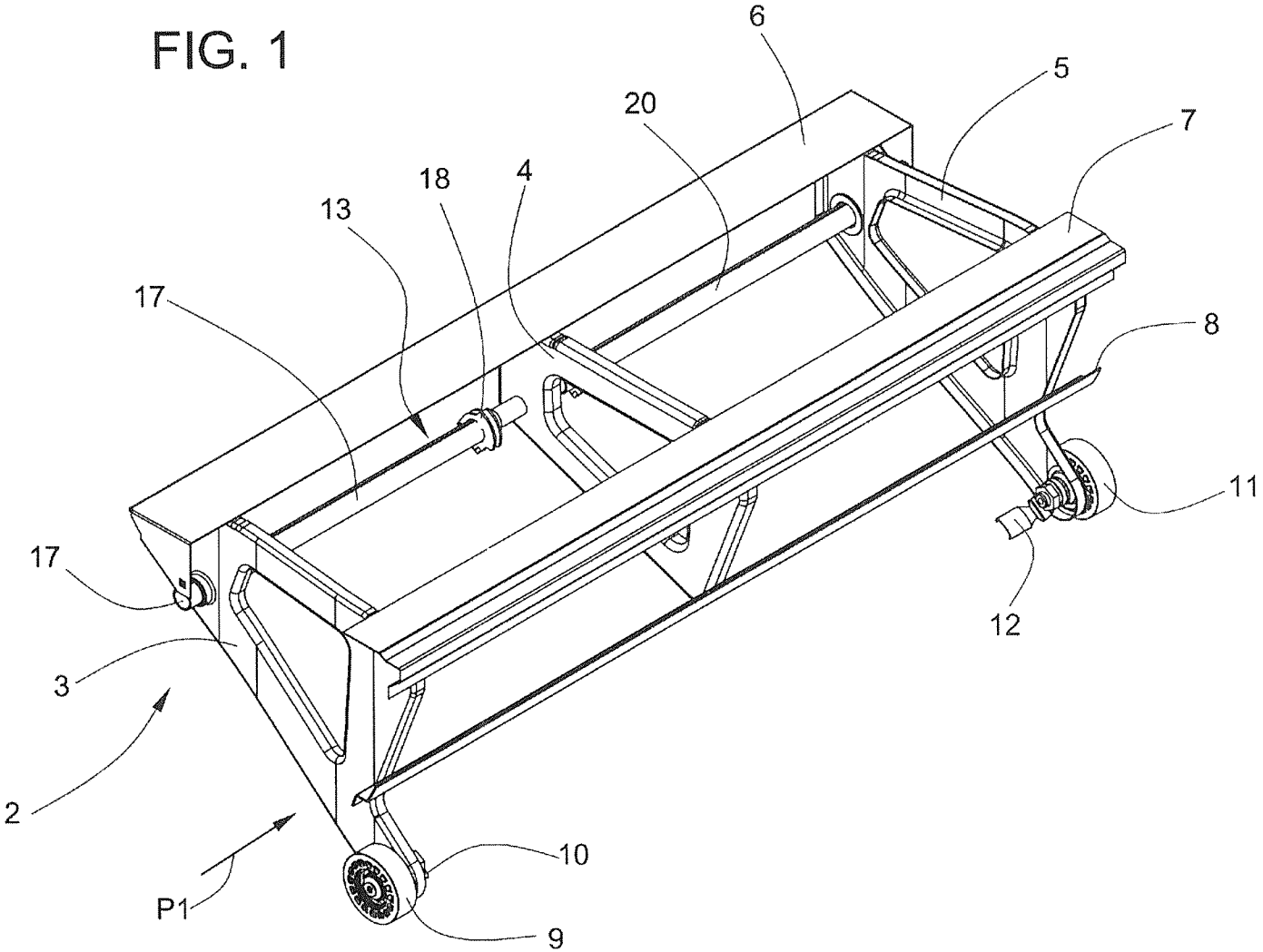
FIG. 1 shows a skeleton of the step according to the invention.

FIG. 1 shows a step skeleton 2 of the step 1 according to the invention. The step skeleton 2 consists of a first cheek 3, at least one centre cheek 4 and a second cheek 5. First and second cheeks 3, 5 are also termed side cheeks and are arranged in mirror image. The cheeks 3, 4, 5 are arranged in travel direction. A sheet metal blank is punched from a sheet metal strip for each cheek 3, 4, 5 and this blank is subsequently reshaped by means of a deep-drawing method to form the cheek. A carrier 6, a bridge 7 and a bracket 8 extend transversely to the travel direction and connect the cheeks 3, 4, 5, wherein the components are connected without screws, for example by means of a spot-welding method. Cheeks 3, 4, 5, carrier 6, bridge 7 and bracket 8 form the step skeleton. The components of carrier 6, bridge 7 and bracket 8 are produced in endless manner from the sheet metal coil by means of a roller reshaping method, for example with a production speed of 10 to 20 metres per minute, and cut to length according to the respective step width. Stainless steel sheet or zinc sheet or copper sheet or brass sheet with a thickness of 1.8 to 3.3 mm is provided for the components of carrier 6, bridge 7 and bracket 8. Other constructional materials such as, for example, synthetic fibre composites or natural fibre composites or carbonfibre composites or glassfibre composites or plastics materials are also possible.

A step roller 9 and an emergency guide hook 10 are arranged at the first cheek 3. A step roller 11 and an emergency guide hook 12 are arranged at the second cheek 5. The step roller 9, 11 guides the step 1 along a guide track of the escalator. The emergency guide hook 10, 12 is supported, in the event of failure of the step roller 9, 11, on an emergency guide of the escalator and forces the step 1 back to the guide track.

The step 1 is connected with the step chain of the escalator by means of a step axle 13. The step axle 13 is of multi-part construction. An axle pin 14 made from a round material is rotatably mounted in a bush 15, which serves as slide bearing, of the centre cheek 4. A bush 16 serving as a slide bearing is arranged at the first cheek 3, wherein a first entrainer axle 17 is rotatably mounted at one end in the bush 16 and is connected at the other end by means of a shackle 18 with the axle pin 14 of the centre cheek 4. A bush 19 serving as a slide bearing is arranged at the second cheek 5, wherein a second entrainer axle 20 is rotatably mounted at one end in the bush 19 and is connected at the other end by means of a shackle 21 with the axle pin 14 of the centre cheek 4.

The entrainer axles 17, 20 are produced from sheet metal coil by means of a roll deforming method and cut to length depending on the respective step width. With the shackle 18, 21 released the entrainer axle 17, 20 is pushed, at each side of the step 1, over a chain pin of the step chain and the shackle 18, 21 retightened, whereby the step 1 is connected with the step chain moving the step 1.

The step axle 13 forms, together with the chain pin, a continuous axle from one chain roller to the opposite chain roller. The step 1 is thus carried at one end by the chain rollers and at the other end by the step rollers 9, 11.

Figure 2:
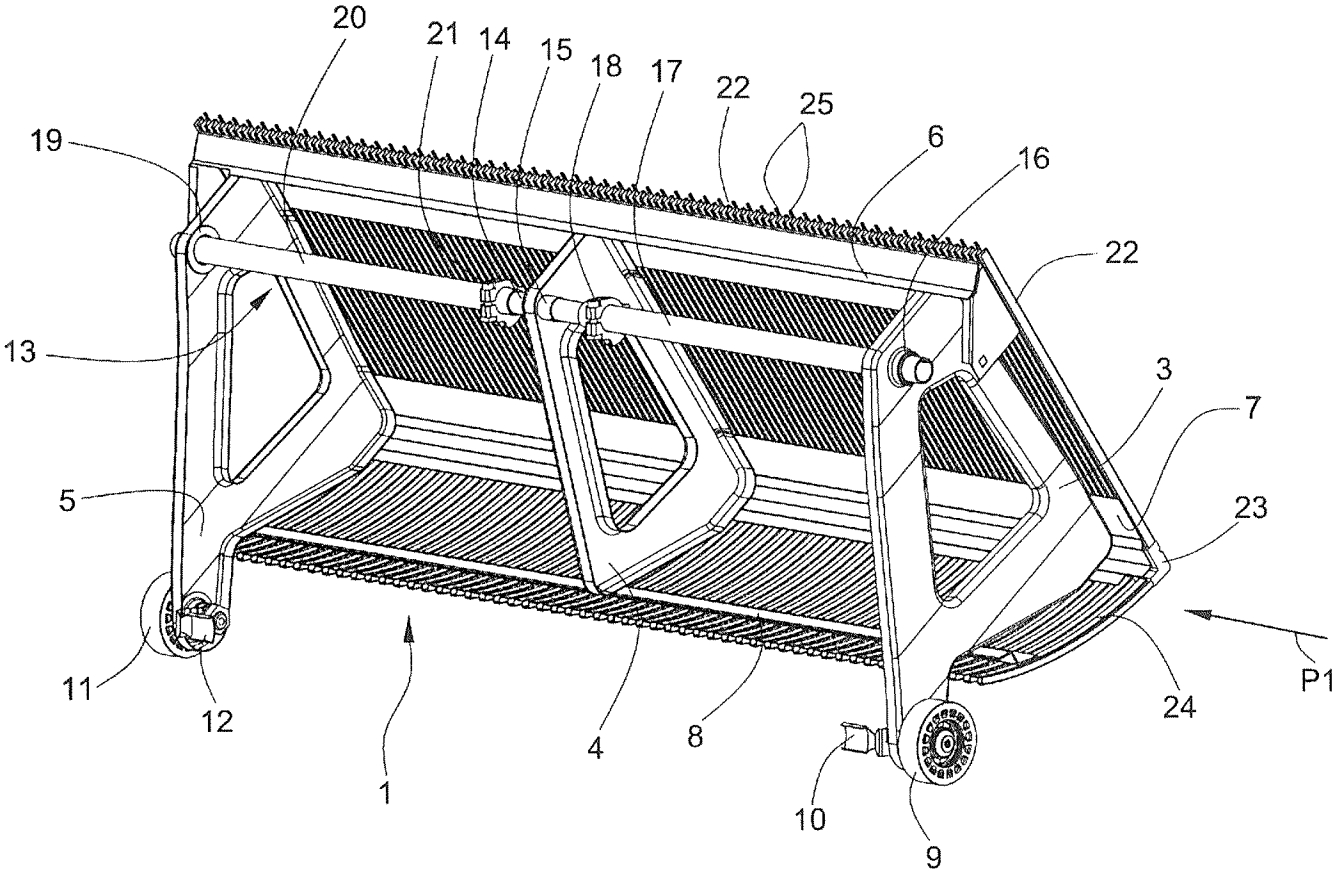
FIG. 2 shows the step according to the invention.

FIG. 2 shows the complete step 1 as seen from below, in which the step skeleton 2 has been supplemented by a tread element 22, a step edge 23 and a riser element 24. The tread element 22 and/or the riser element 24 can also consist of more than one part. For example, the one-piece tread element 22 or the one-piece riser element 24 can be divided longitudinally as seen in travel direction and/or transversely thereto. The tread element 22 and also the riser element 24 are produced in two stages. In a first stage the sheet metal drawn off the sheet metal coil is straightened and pre-shaped or pre-corrugated by means of a splined shaft to the extent of approximately 50% and subsequently cut to length depending on the respective step spacing. In a second stage the pre-shaped component is reshaped by means of a deep-drawing method to form the final web/groove profile with webs and grooves. The tread element 22 and also the riser element 24 can also be deep-drawn in one step, wherein 3 to 10 webs and grooves are deep-drawn, the deep-drawn sheet metal is subsequently pushed onward, then a further 3 to 10 webs and grooves are deep-drawn, and so on. In total, a deep-drawn sheet metal plate of, for example, 0.25 to 1.25 mm thickness is deep-drawn to 10 to 15 mm. The web/groove profile of the tread element 25 has on the support side at each second web a small tooth 25 which meshes with the web/groove profile of the riser element 24 of the adjacent step. The gap between the steps is thereby set forward and set back.

The step edge 23, which, for example, is made of ceramic or natural fibre or plastics material in an injection-moulding process or of aluminium in a die-casting process, is placed on the bridge 7 and screw-connected from below with the bridge 7. Other materials such as natural fibre materials, synthetic fibre materials, glassfibre composites, carbonfibre composites or plastics material or stainless steel and colours such as yellow, red, black, blue or mixed colours are also possible. The step edge 23 is so constructed that the tread element 22 and also the riser element 24 can be pushed into the step edge 23.

Figure 3:
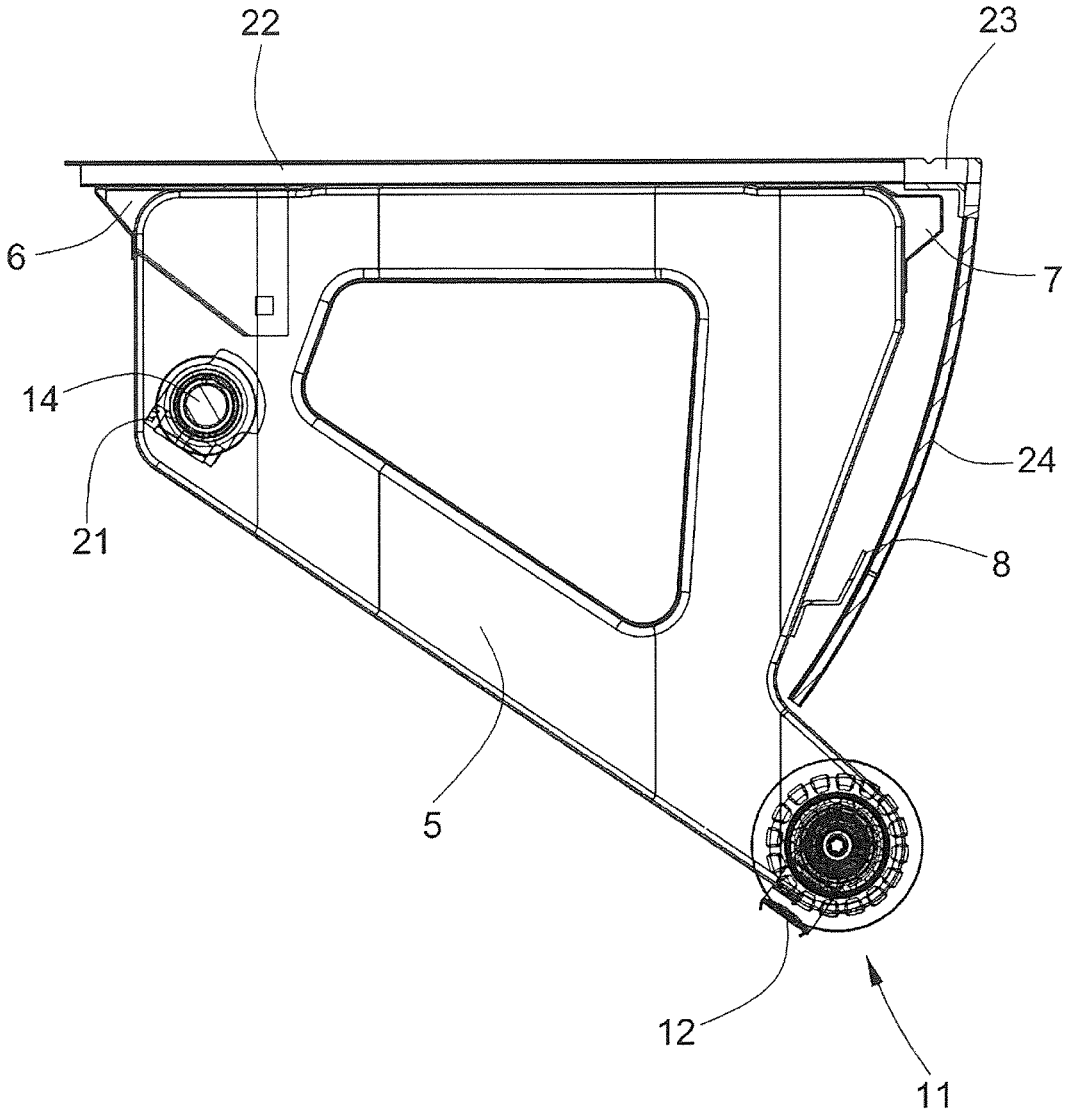
FIG. 3 shows a section through the step in travel direction.

FIG. 3 shows a section as seen in travel direction through the step 1 at the position of the axle pin 14 on the second cheek 5. The tread element 22 is connected in screw-free manner, for example by way of a spot-welding method, with the carrier 6 and the bridge 7. The riser element 24 is pushed into the step edge 23 and connected in screw-free manner, for example by way of a spot-welding method, with the bracket 8.

Depending on the respective customer wish, stainless steel, aluminium, synthetic fibre composites, ceramic, copper, brass, titanium plate and so forth are conceivable for the tread element 22 and for the riser element 24.

Figure 4:
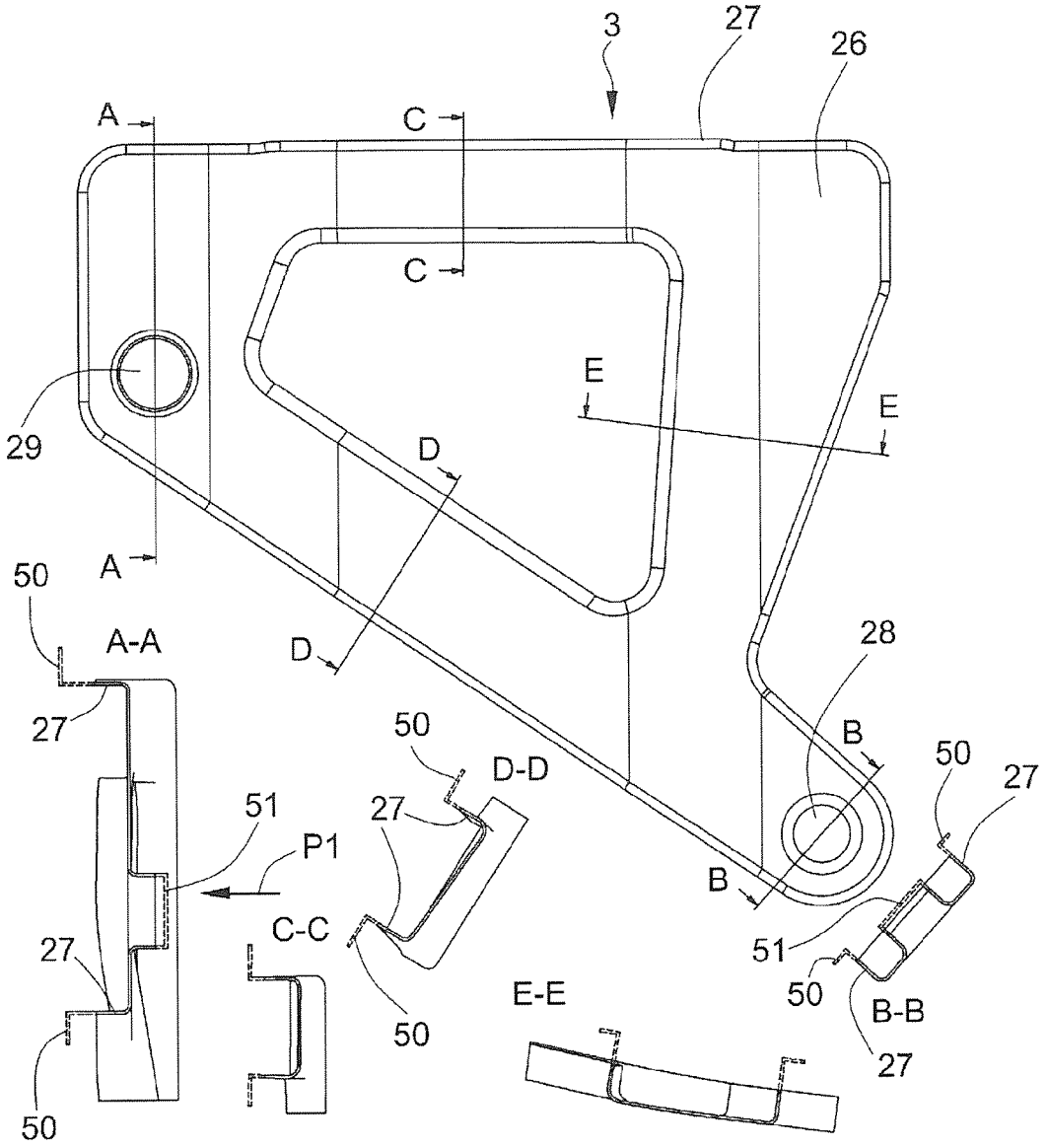
FIG. 4 shows a side view of a cheek with sections A-A to E-E.

FIG. 4 shows a side view of the first cheek 3 as seen from outside or in the direction of the arrow denoted by P1. As explained further above, the sheet metal blank is fixedly held at the edge by means of holding-down devices and the free area of the deep-drawn sheet metal is pressed by means of a die into a die plate. In that case the base of the three-dimensional body is shaped to form the cheek body 26 and the walls and bend radii of the three-dimensional body for the stiffening 27 of the cheek body 26, wherein of the stiffening 27 merely the bend radii are visible, the actual stiffening 27 or the walls of the three-dimensional body being merged into the plane of the drawing.

FIG. 4 shows, in addition, sections along the lines A-A, B-B, C-C, D-D and E-E. The parts of the deep-drawn body which are removed by means of knife or laser after the deep-drawing process are illustrated by dashed lines, particularly the edges 50 held fast during the deep-drawing process and the cover 51 of the cheek eyes 28, 29 for the step roller 9 and the entrainer axle 17. The cheek eye 28 for the step roller 9 is oriented or deep-drawn in the direction of the stiffening 27 or inwardly (section B-B) and the cheek eye 29 for the entrainer axle 17 is oriented or deep-drawn outwardly, opposite to the direction P1 (section A-A).

Figure 5:
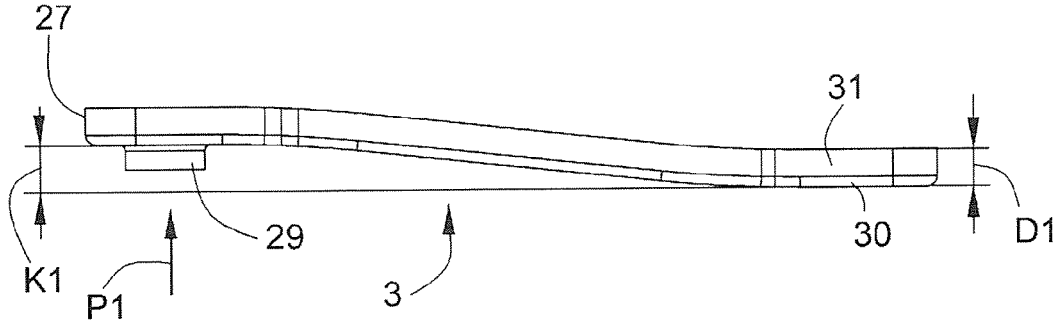
FIG. 5 shows a plan view of the cheek.

FIG. 5 shows a plan view of the first cheek 3. The first cheek 3 has, for stiffening, a slight inward cranking K1, wherein K1 can be, for example 20 to 35 mm. The thickness of stiffening 27 is denoted by D1, wherein D1 is composed of the thickness of the deep-drawn sheet metal, the bend radius 30 and the deep-drawn wall 31. D1 can be, for example, 15-42 mm, wherein the thickness of the deep-drawn sheet metal 1 can be 1.1-2.2 mm and wherein the ratio of the sheet metal thickness of the cheek body 26, 32 of the cheeks 3, 4, 5 to the height D1 of the stiffening 27, 44 is at least 1:10. In the case of a density of 7.87 g/cm$^3$ a deep-drawn sheet metal has a weight of 14.4 kg/m$^2$ for a sheet metal thickness of 1.8 mm and a weight of 9.6 kg/m$^2$ for a sheet metal thickness of 1.2 mm. The second cheek 5 is constructed comparably to the one-piece first cheek 3. The centre cheek 4 is similarly deep-drawn and, apart from the cranking K1 and the cheek eyes, constructed comparably to the first cheek 3. The sheet metal thickness of the deep-drawn sheet metal can be selected in dependence on the step width (the smaller the step width, the thinner the sheet metal) or the same sheet metal thickness can be used for different step widths.

Figure 6:
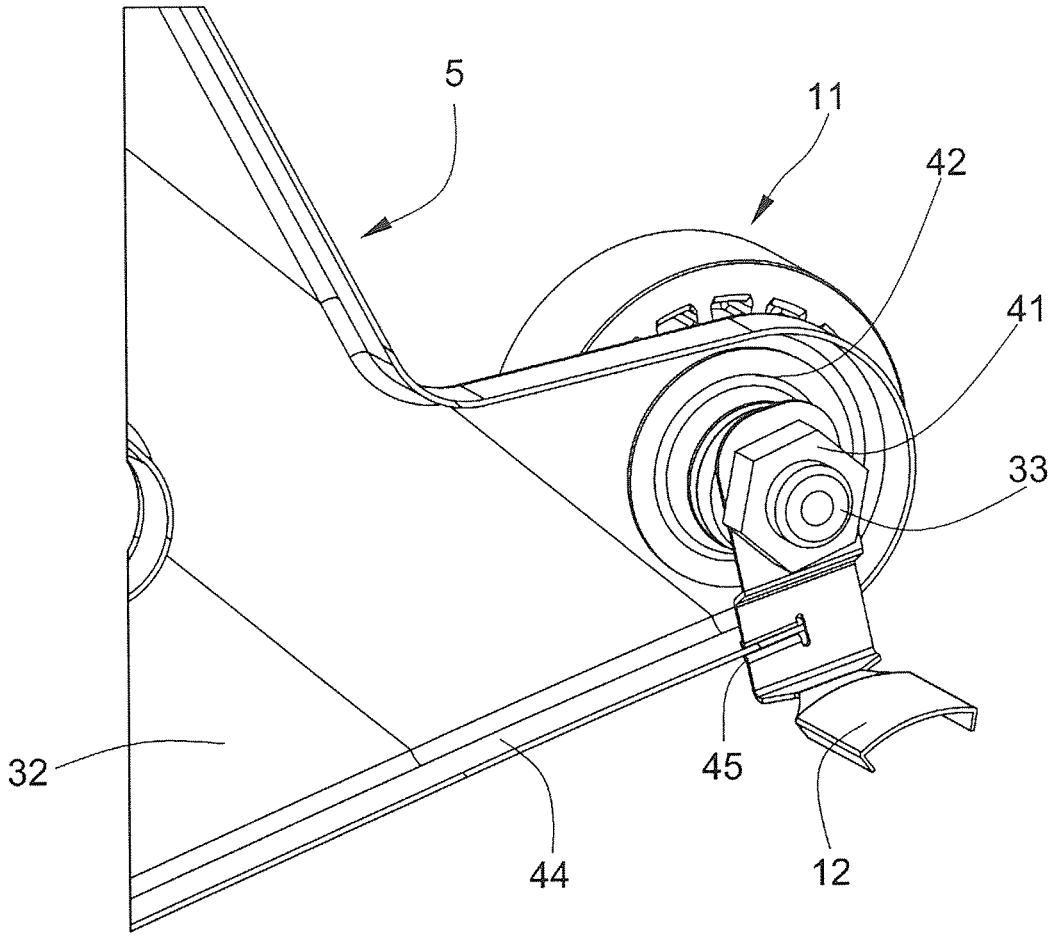
FIG. 6 shows a cheek with step roller and emergency guide hook.
Figure 7:
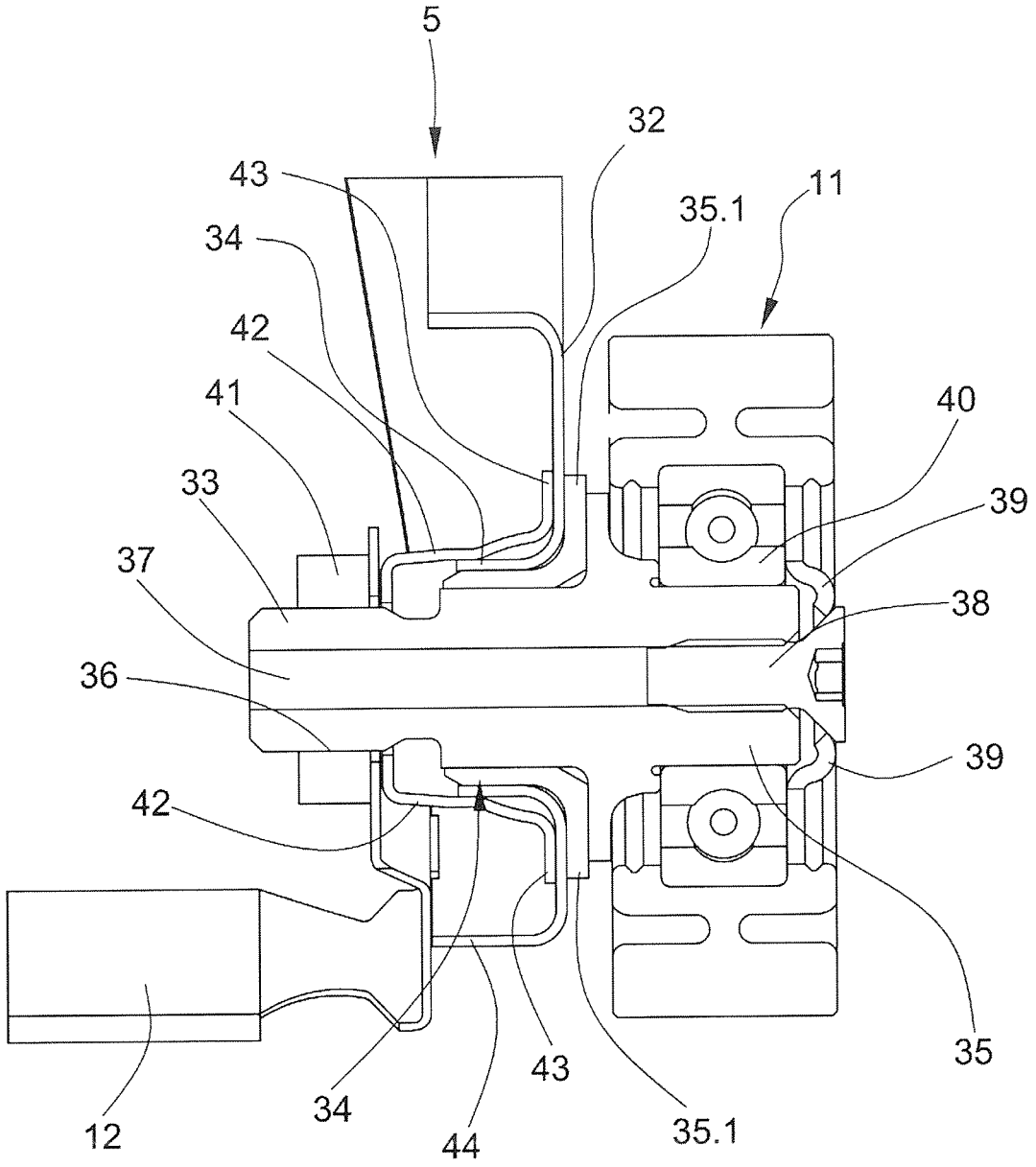
FIG. 7 shows details of a bearing for a roller.
Figure 8:
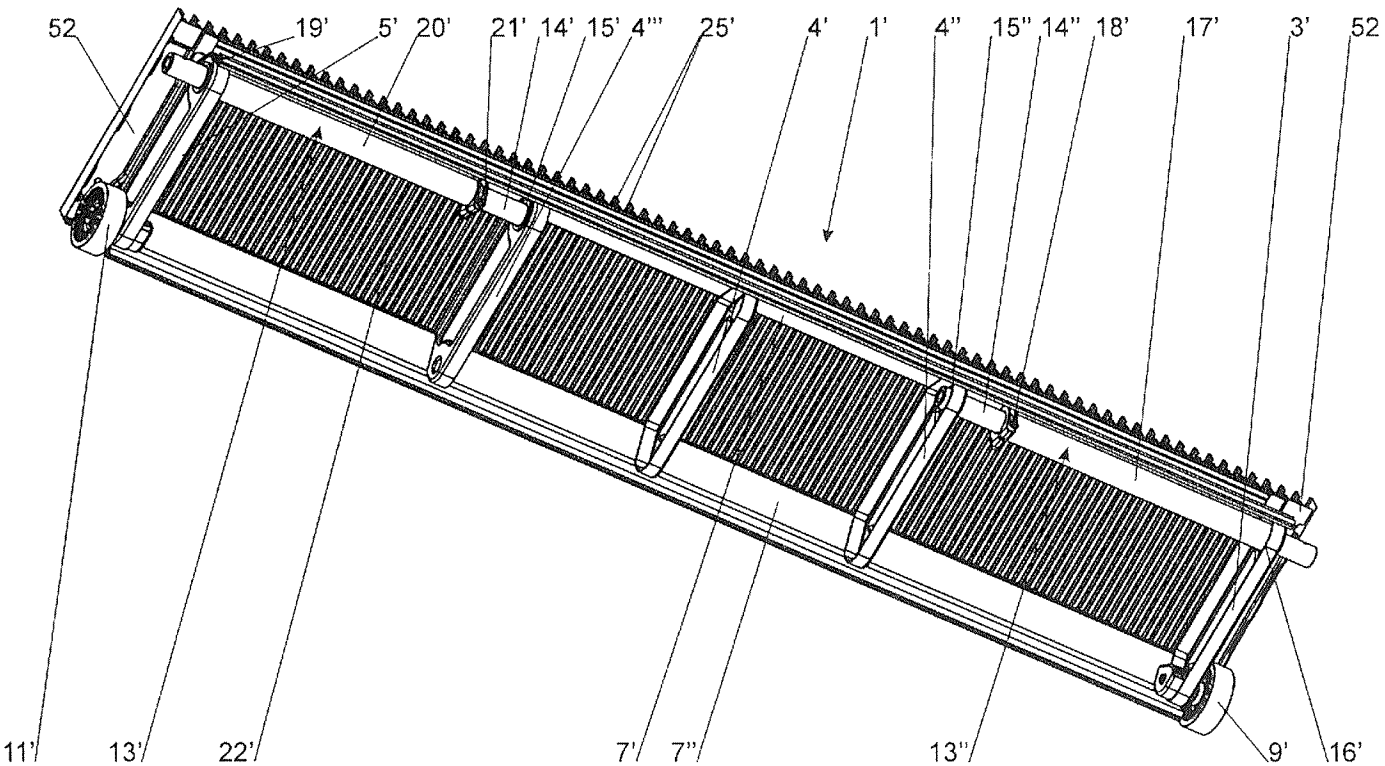
FIG. 8 shows a plate according to the invention in perspective view from below.

FIG. 6 and FIG. 7 show the second cheek 5 with details of the fastening of the step roller 11 and the emergency guide hook 12 at the cheek body 32 with stiffening 44. The fastening of the step roller 9 and the emergency guide hook to the first cheek 3 is identical. A further emergency guide hook can be arranged at the cheek body 26 or 32. An axle pin 33 is held by a bush 35.1, which is, for example, pressed or clamped or screwed into the cheek eye 34. The axle pin 33 has at one end a bearing pin 35 for mounting the bearing of the roller and at the other end a thread 36. A screw 38 self-tapping in a bore 37 of the axle pin presses a washer 39 onto a bearing race 40 of the bearing for the roller. A nut 41 screwed onto the thread 36 presses the emergency guide hook 12 against a cap 42, which is supported by means of a wide cap edge 43 at the cheek body 32. The cap 42 additionally strengthens the connection of the axle pin 33 with the cheek body 32 and stiffens the cheek body 20 at this location. Provided at the emergency guide hook 12 is a slot with a bend 45, which during tightening of the nut 41 secures the emergency guide hook 12 against rotation and fixes it to the stiffening 44.

A plate according to the invention is now explained with reference to FIGS. 8 to 12. Many parts have correspondence with the step; these bear the same reference numerals, but provided with one or more apostrophes, the tread element of the plate thus having the reference numeral 22' because the tread element of the step is denoted by 22. Insofar as there is correspondence with the step, the parts are not explained again.

Since moving walkways are usually wider than escalators, several centre cheeks are necessary for a plate 1': in the illustrated example there are three centre cheeks 4', 4" and 4'". Together with the two side cheeks 3' and 5', there are five cheeks in total. Since plates are substantially symmetrical front/back, two carriers 7' and 7" are provided, which are identical (instead of carrier 7 and bridge 6 in the case of the step 1), in order to mount the tread element 22'. The carriers 7', 7" are connected with the cheeks 3', 4', 4", 4'" and 5' without screws, for example by means of a spot-welding method. Since plates do not have a riser element, the step edge 23 and the bracket 8 are also redundant. So that the cheeks 3', 4', 4", 4'" and 5' are also stable at the lower side thereof (the side remote from the tread element 22') the bridges 7', 7" are so constructed that they largely follow the shape of the cheeks 3', 4', 4", 4'" and 5' (cf. FIGS. 11 and 9). The bridges 7', 7" together with the cheeks 3; 4', 4", 4'" and 5' thus form a skeleton just as stable as the components 6, 7 and 8 with the cheeks 3, 4 and 5 in the case of the step.

The bridges 7', 7" also have (just like the components 6, 7 and 8 of the step) a constant cross-section over their entire length, so that they can be produced in endless manner by means of a roller deforming process and cut to length depending on the respective plate width. A particular advantage here is that the bridges 7' and 7" can be produced identically; a bridge 7' can be mounted in the mirror-image position, which is required for the bridge 7", simply by being turned over.

The plate rollers 9' and 11' are fastened analogously to the step rollers 9 and 11. Emergency guide hooks are superfluous in the case of plates.

Different, however, is the plate axle 13', which by contrast to the step axle 13 is not continuous, but divided in two. This is possible for the reason that several centre cheeks 4', 4" and 4''' are provided. There are therefore two axle pins 14', 14'', which are mounted in the centre cheeks 4''' and 4''. The mounting of the entrainer axles 17' and 20' in the side cheeks 3' and 5' as well as the connection by means of shackles 18' and 21' are analogous to the step 1.

The tread element 22' of the plate 1' also has on the support side at each second web a small tooth 25. On the roller side exactly each intermediately disposed web has such a small protruding tooth (not visible in FIG. 8). The gap between two plates 1' is therefore set forward and set back just as in the case of the steps.

Figure 9:
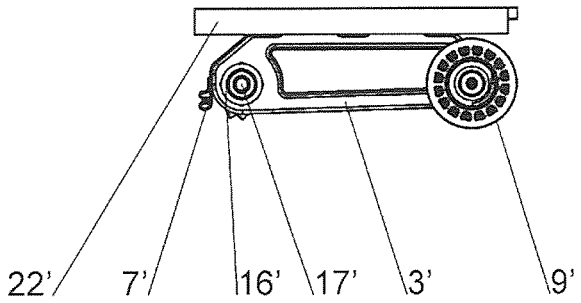
FIG. 9 shows the same in side view.

FIG. 9 shows a plate from the side. It was already mentioned that the cheeks (in FIG. 9 only the cheek 3' is visible) are connected with the bridges 7' and 7'' (not visible in FIG. 9) without screws, for example by way of a spot-welding method. Similarly, the tread element 22' is connected with the two bridges 7' and 7'' without screws, for example by way of a spot-welding method.

Figure 10:
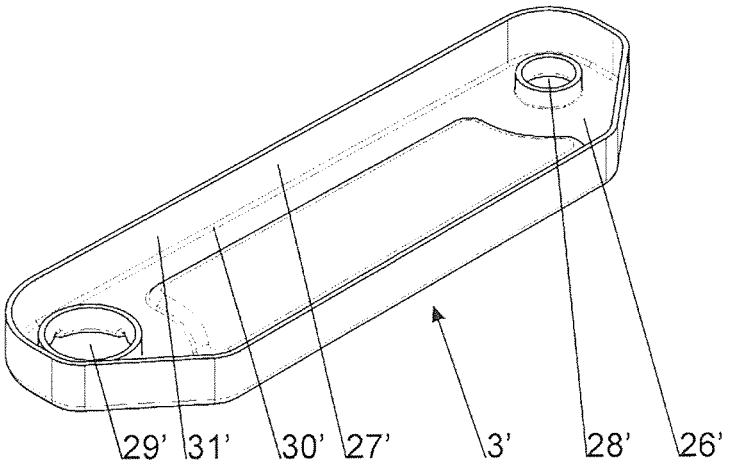
FIG. 10 shows a cheek of this plate.
Figure 11:
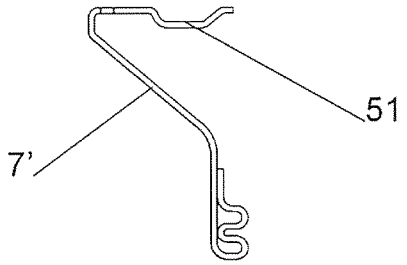
FIG. 11 shows a bridge of this plate in side view.
Figure 12:
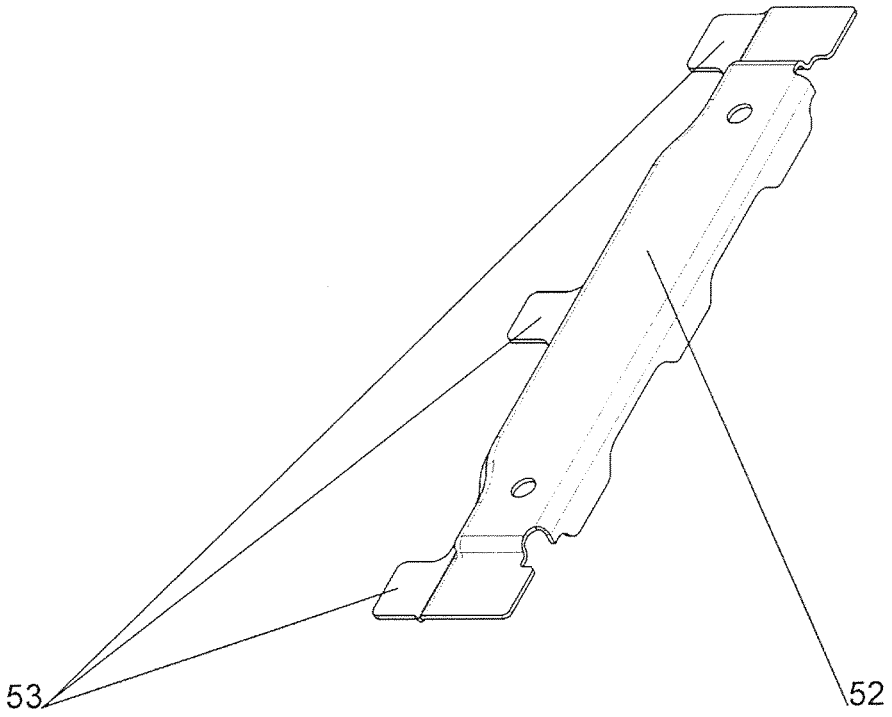
FIG. 12 shows a support of this plate in perspective view.

FIG. 10 shows a cheek 3' of a plate in perspective view. This cheek is also produced (analogously to the cheeks in the case of the step) by a deep-drawing method. Here, too, a stiffening 27' through an encircling wall 31' produced during the deep-drawing is present, which wall goes over by a bend radius 30' into the cheek body 32'. The production of the cheek eyes 28' and 29' is also carried out entirely analogously to that explained in the case of the step.

The bridge 7' has at its upper side, by which it bears against the tread element 22', a depression 51. The same obviously applies to the bridge 7''. Thus, slots into which a support 52 can be pushed by tabs 53 arise between the two bridges 7' and 7'' on the one hand and the tread element 22'. This support 52 supports the tread element 22' at the two lateral edges where the tread element 22' projects beyond the bridges 7' and 7'' (the bridges 7' and 7'' end at the side cheeks 3' and 5'). The tread element is thus supported over its entire width.

The invention claimed is:

1. A construction for an escalator step or a moving walkway plate, comprising a skeleton supporting at least one tread element, the skeleton having load-bearing side cheeks and at least one center cheek, the cheeks extending in a travel direction of the construction, the cheeks each comprising a cheek body and a stiffening wall along edges of the cheek body, the step skeleton being constructed from deep-drawn sheet metal parts connected by components extending transversely to the travel direction, such that, when the construction is loaded, a load force is distributed to all the cheeks, wherein each side cheek has a respective roller supported by an axle pin extending through a drawn cheek eye, each side cheek further having reinforcement means for the cheek eye in the form of a cap engaging the cheek eye adapted and constructed to strengthen the connection of the axle pin with the cheek body and stiffen the cheek body, the cap having a wide supporting cap edge bearing directly against the cheek body and reinforcing an edge of the cheek eye.

2. A construction according to claim 1, wherein the step skeleton additionally serves as a support for at least one riser element.

3. A construction according to claim 1 or 2, wherein a ratio of a thickness of the cheek body to a height of the stiffening wall of the cheek is at least 1:10.

4. A construction according to claim 1 or 2, further comprising an axle extending through the cheeks that includes, at each side of the construction, a respective entrainer axle.

5. A construction according to claim 1 or 2, wherein the connecting components connecting the cheeks comprise a carrier, a bridge and a bracket connected to the cheeks without screws and connected to the tread element and the riser element without screws.

6. A construction according to claim 5, further comprising a step edge for insertion of one of the tread element and the riser element is arranged at the bridge.

7. A construction for a moving walkway plate according to claim 1, wherein the components connecting the cheeks are two bridges connected to the cheeks without screws and connected to the tread element without screws.

8. A construction according to claim 1 or 2, wherein the construction has a weight of approximately 8.6 kilograms for a construction width of 600 millimeters, a weight of approximately 10.8 kilograms for a construction width of 800 millimeters, or a weight of approximately 13.1 kilograms for a construction width 1000 millimeters.

9. An escalator with at least one step according to claim 1.

10. A moving walkway with at least one plate according to claim 1.

* * * * *